United States Patent [19]

Wichman et al.

[11] Patent Number: 4,809,471

[45] Date of Patent: Mar. 7, 1989

[54] DIAGONAL ASSEMBLY FOR FOLDING DISPLAY FRAMES

[75] Inventors: William J. Wichman, 702 Brownsage Dr., Glendora, Calif. 91740; Max A. Graham, Steamboat Springs, Colo.

[73] Assignee: William J. Wichman, Glendora, Calif.

[21] Appl. No.: 202,697

[22] Filed: Jun. 3, 1988

[51] Int. Cl.[4] ..... A47F 5/13; E04B 2/74

[52] U.S. Cl. ..... 52/109; 52/646

[58] Field of Search ..... 52/109, 646, 81; 182/17, 157, 158; 40/610

[56] References Cited

U.S. PATENT DOCUMENTS

| | | | |
|---|---|---|---|
| 4,017,932 | 4/1977 | Saggin | 52/646 |
| 4,276,726 | 7/1981 | Derus | 52/109 |
| 4,437,275 | 3/1984 | Zeigler | 52/109 |
| 4,477,803 | 7/1987 | Mikulas | 52/646 |
| 4,539,786 | 9/1985 | Nelson | 52/646 |
| 4,655,022 | 4/1987 | Natori | 52/646 |
| 4,663,899 | 5/1987 | Nodskov | 52/109 |

*Primary Examiner*—John E. Murtagh

*Attorney, Agent, or Firm*—Christie, Parker & Hale

[57] ABSTRACT

A folding display frame comprises a grid of horizontal and vertical rod members forming an array of three dimensional cubicles. The cubicles have eight corners with a separate hub at each corner of the cubicle. The framework forming each cubicle has a top frame section, a bottom frame section, and two side frame sections. Each frame section is formed by two rods intersecting and pivotally join to each other midway between their ends. The ends of the rods in each cubicle are pivotally attached to corresponding hubs located at each of the corners of the cubicle. Adjacent cubicles in the array share common rods and hubs. Separate diagonal stabilizing members are located within bottom cubicles of the display frame to prevent the cubicles from being distorted into a parallelogram shape when the frame is erected in its fixed position and weight is supported on the front of the frame. Each diagonal stabilizing member comprises a telescoping brace comprised of inner and outer rod members slidable relative to each other to adjust the length of the brace. The rod members have means for restricting their maximum length, and the diagonal braces are mounted within the bottom cubicles so that they act as a restraint in the tension direction to restrict the bottom cubicles from distorting into a parallelogram shape.

5 Claims, 10 Drawing Sheets

DIAGONAL ASSEMBLY FOR FOLDING DISPLAY FRAMES

FIELD OF THE INVENTION

This invention relates to folding display frames, and more particularly, to a diagonal assembly for stabilizing a folding display frame in its expanded form.

BACKGROUND OF THE INVENTION

Folding display frames are commonly used for assembling temporary upright display stands for holding display panels with graphic materials displayed at trade shows. Photomural displays and other graphics, projection screens, and product display shelves, for example, are commonly mounted on the portable display stands.

Folding display frames typically comprise a number of rigid frame members pivotally connected together at their ends in a collapsible and portable form. The framework in its expanded or open state commonly consists of a grid of horizontal and vertical rod members forming an array of cubicles. The frame is carried to the exhibition hall in its collapsed form and then is erected to form the rigid structural framework for a display stand. Display panels, which are mounted to the display frame, and other structural members of the supporting frame also are carried to the trade show in a compact form. The entire folding display system is then assembled into the finished display unit.

In a typical three-dimensional framework, a plurality of rod members are pivotally connected together to permit collapsing of the framework into a compact form in which the rod members lie substantially parallel to each other. Except where the framework is assembled in a substantially permanent structure, the rod members are pivotally joined at their ends to hubs at the corners of the cubicles so that the rods can be rotated relative to each other as the framework is adjusted between its open expanded configuration and its closed compact configuration.

One of the objectives in designing folding display frames is to make the structure light in weight and compact in its folded form to enhance ease of transportation and storage when the framework is not in use. At the same time, the framework, when fully expanded into its useful configuration, must be strong and fairly rigid. The framework must not only be strong enough to give adequate support, but it must also withstand abuse, particularly when being folded and erected. A commonly desirable display frame configuration is one in which the upright frame has a curved configuration, i.e., the frame is arcuate in the plan view shape of the expanded frame. Such an expanded frame configuration tends to be more stable than an expanded display frame in a flat form. However, the curved display frame also can be unstable because of its relatively large size and the relative light weight of the expanded frame. Because of the curved shape of the frame and because weight hung from the frame is always on the front side, the forces resisting forward tipping of the frame are concentrated on the front extreme left and right bottom hubs of the framework. This load causes a distortion of the bottom outer cubicles of the frame into parallelograms, with the outermost frame cubicle on either the left or right side moving upward with respect to the next inward vertical cubicle.

Thus, there is a need to provide a means for stabilizing such a display frame in its expanded form to prevent the display frame from tipping over under the weight normally carried by the frame during use.

Various stabilizing means can be used to either resist distortion of the expanded display frame, or to otherwise add to its stability. However, these stabilizing systems often have many disadvantages. For instance, addition of external stabilizing members can be a disadvantage if they unnecessarily add to the weight of the unit, or if they unreasonably increase the weight of the display system. Some stabilizing systems are unreasonably complex. One folding display frame uses four crossed diagonal braces within each frame array to provide stabilization. The stabilizing frame members of some display frames must be latched in place when the frame is expanded and then disconnected when the frame is folded. Aside from the additional time required to assemble the frame and then disassemble it, these devices also can be difficult to unlatch if the diagonal braces cannot easily move lengthwise. In other instances where stabilizing members are incorporated into the frame, the additional stabilizing members can prevent the frame from being collapsed into a compact folded position.

Thus, there is a need for a simple, lightweight folding display frame which can be quickly and easily unfolded and assembled into a stabilized expanded configuration. It is desirable for the framework to expand into its assembled stable form without the necessity of adding external stabilizing members once the frame is unfolded. The stabilized expanded display frame also should be foldable easily into a compact form without the stabilizing members unnecessarily increasing the folded size of the framework.

SUMMARY OF THE INVENTION

The present invention is directed to an improved folding display frame that unfolds into a stabilized expanded configuration. The stabilizing members of the frame are arranged to resist forces that normally would cause the frame to distort when weight is added to the front of the frame. The stabilizing members can be incorporated into the frame so that the frame is opened up and assembled in its expanded configuration or folded into a compact form without the addition of external stabilizing members to the frame.

Briefly, the framework incorporating the features of the present invention, in its expanded or open configuration, comprises a grid of horizontal or vertical rod members forming an array of three dimensional cubicles. Each cubicle is defined by a top plane, a bottom plane, two side planes, a front plane and a rear plane. These planes cooperate to define eight corners of each cubicle which can be of three dimensional square or rectangular configuration. The framework forming each cubicle has a top frame section, a bottom frame section, and two side frame sections. Each frame section is formed by two rods intersecting and pivotally joined to each other midway between their ends. The ends of the rods in each cubicle are pivotally attached to corresponding hubs located at each of the corners of the cubicle. Adjacent cubicles in the array share common rods and hubs. Separate diagonal stabilizing members located within bottom cubicles prevent these cubicles from being distorted into a parallelogram when the display frame is assembled into its expanded configuration. Each diagonal stabilizing member comprises a telescoping brace comprised of inner and outer rod members. The rod members of each telescoping brace are slidable relative to each other to adjust the length of the brace. The rod members of each diagonal brace have means for restricting the maximum longitudinal dimension of the brace. The diagonal braces are mounted within the bottom cubicles of the display frame so that they operate as a restraint in the tension direction, to restrict the bottom cubicles from distorting into a parallelogram shape, particularly under weight attached to the fixed display frame. When the display frame is folded into its compact configuration, the slidable telescoping rod members of each diagonal brace slide relative to each other to permit the frame to be folded into a compact form without interference by the diagonal stabilizing members.

In a preferred form of the invention, the diagonal braces are arranged in the bottom cubicles to slant in one direction on one side of the frame and to slant in an opposite direction on the other side of the frame. Further, each diagonal brace extends from a hub at a front corner of the cubicle to a hub at a rear corner of the cubicle.

This arrangement of diagonal braces provides an effective means of acting as a restraint in the tension direction under forces that would otherwise cause the bottom cubicles to be distorted into a parallelogram shape, while also providing an effective means for collapsing the framework into a compact form without interference by the attached diagonal members. In an alternate form of the invention, these diagonal members can be easily latched in place after the frame is erected into its fixed position.

These and other aspects of the invention will be more fully understood by referring to the following detailed description and the accompanying drawings.

DETAILED DESCRIPTION

Figure 1:
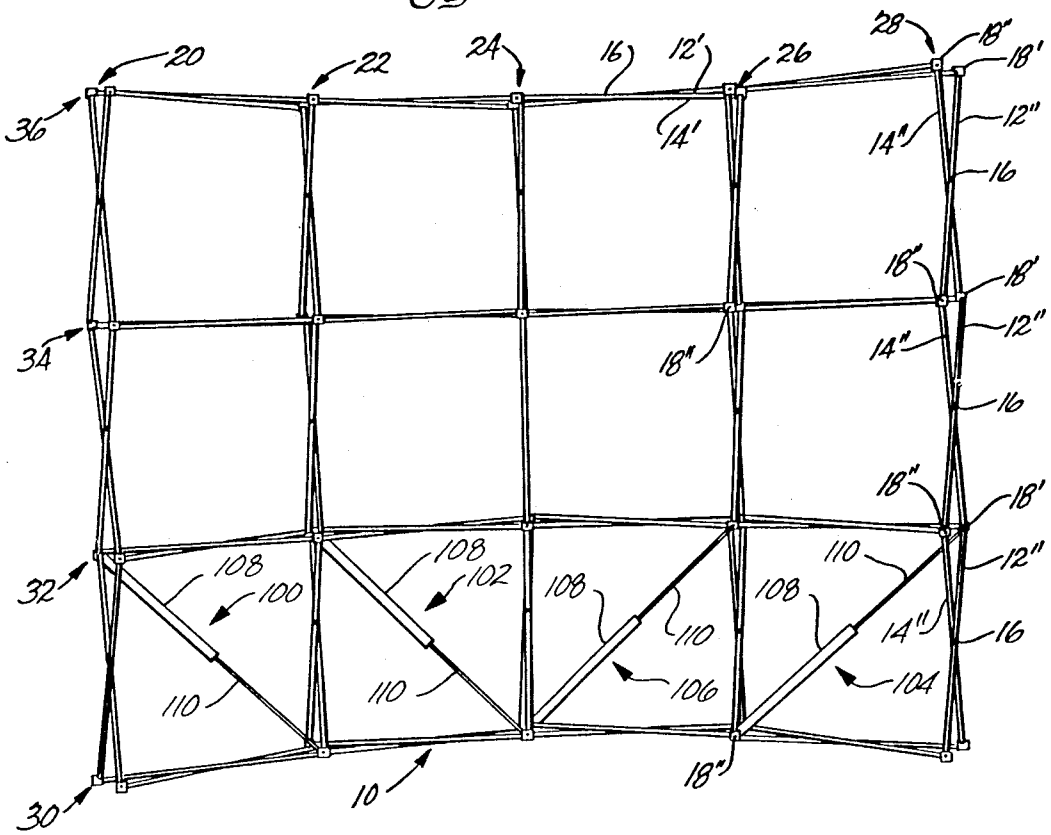
FIG. 1 is an elevation view illustrating a folding display frame in an expanded position.
Figure 2:
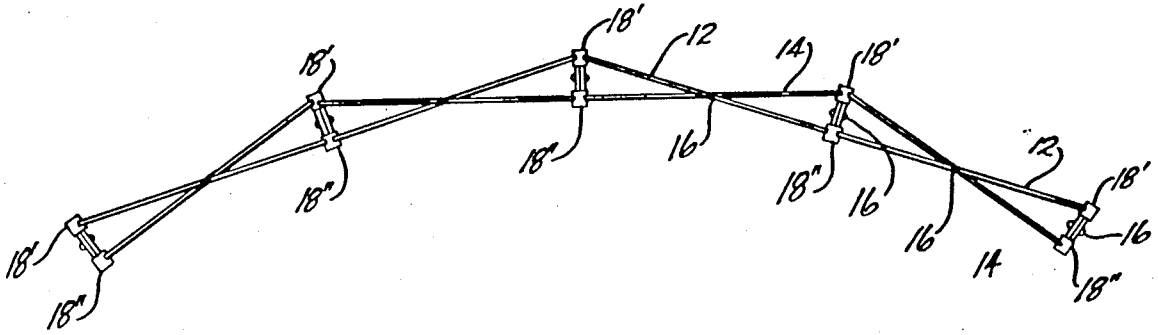
FIG. 2 is a top view of the expanded display frame.

Referring to FIG. in detail, the numeral 10 indicates generally a folding framework shown in its open or expanded position. The framework is constructed of a plurality of pairs of rods, in the form of thin-walled metal tubes, such as indicated at 12 and 14. The rods of each pair are pivotally joined together by a hinge pin 16. The hinge pins 16 are located between the ends of the rods, allowing the rods to swivel with respect to each other in scissors-like fashion. These rod pairs are joined to form a grid-like framework, with the multiple pairs of rods being arranged in vertical columns and horizontal rows. The ends of the rods are joined by a plurality of identical hubs 18. As best shown in FIGS. 1 and 2, the framework in the expanded or open condition comprises a plurality of vertical columns, five of which are indicated respectively at 20, 22, 24, 26 and 28. These are joined by a plurality of horizontal rows, four of which are indicated at 30, 32, 34 and 36. Each of the rows, as best shown in the top view of FIG. 2, is made up of pairs of rods 12 and 14 in which the pivot connection 16 is located slightly off the center or mid position between the ends of its respective rods. Since all horizontal rods are of equal length, this causes the four pairs of rods joined in each row to assume a slightly arcuate shape. This shape gives more stability to the frame when it is resting on the floor or some other supporting surface.

The expanded display frame is stabilized by a system of diagonal stabilizing braces described below. These diagonal stabilizing braces are shown in FIG. 1 but are omitted for clarity from FIG. 2 and FIGS. 12 through 14.

Figure 6:
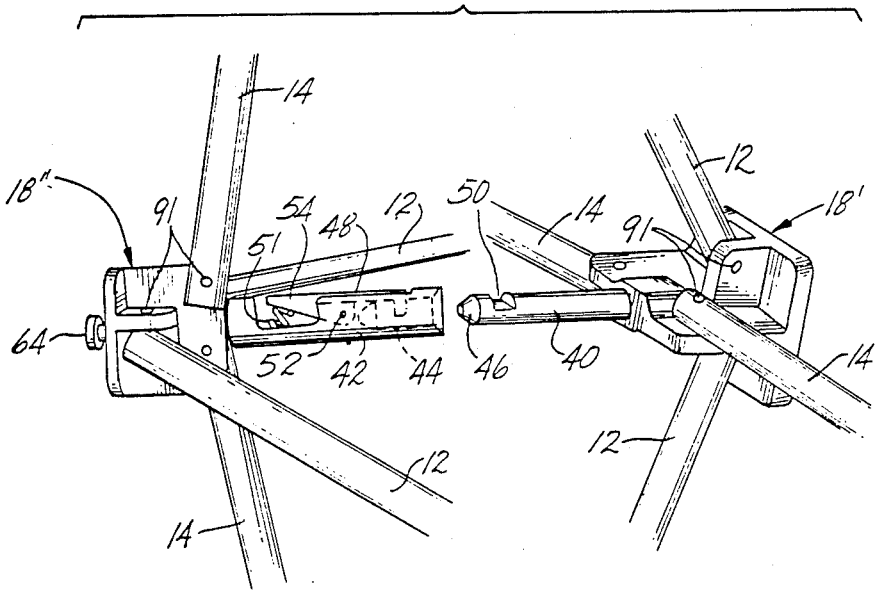
FIG. 6 is a partial view in perspective showing a frame-latching mechanism.

The framework is locked in the expanded position shown in FIGS. 1 and 2 by a suitable latch mechanism which anchors one or more pairs of adjacent hubs 18' and 18'' together A preferred latch for this purpose is shown in detail in FIG. 6. One hub of the pair, such as indicated at 18', has a latch rod 40 which projects toward the adjacent hub 18'' of the pair. As the framework is expanded to its open position by moving the pairs of hubs 18' and 18'' toward each other, the latch rod 40 engages a latch receptacle 42 which is rigidly secured to the hub 18''. The latch rod 40 enters a hole or bore 44 in the end of the latch receptacle 42 where the tapered end 46 of the rod 40 engages a spring-loaded latch pawl 48. As the latch rod is fully inserted into the bore 44, the latch pawl engages a notch 50 in the rod, securely locking the rod 40 in position in the latch receptacle 42. The pawl, which is pivotally supported to the receptacle by a pin 52 can be disengaged from the notch 50 to release the latch by pushing down on the opposite end 54 of the latch pawl 48. The pawl is urged into engagement with the notch 50 by a suitable spring 51. The latch mechanism shown in FIG. 6 need only be provided for one pair of hubs, preferably near the center of the framework grid. If greater rigidity is required, additional pairs of hubs can be provided with such a latch mechanism.

Figure 14:
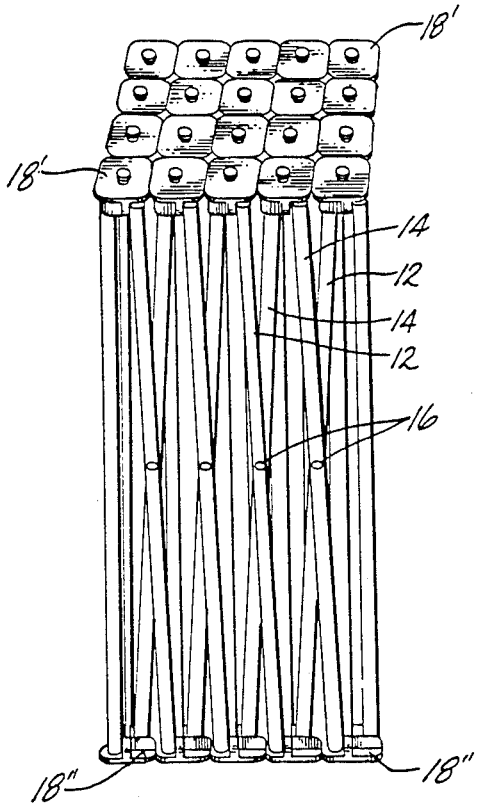
FIG. 14 shows the frame in the folded or collapsed position.

With the latch mechanisms released, the entire framework can be collapsed or folded into the storage condition, as shown in FIG. 14. In this position, the two rods 12 and 14 in each pair of such rods are rotated relative to each other about the connecting pivot 16, allowing each respective pair of hubs 18' and 18'' to be moved apart until the rods 12 rotate almost 180 degrees relative to the other rods 14 of each pair. In the fully folded position, all the hubs 18' move into side-by-side engagement with each other, and all the hubs 18'' also move into engagement with each other. In this way, the hubs are nested in two groups, each group occupying an area which is limited by the size of the hubs.

Figure 3:
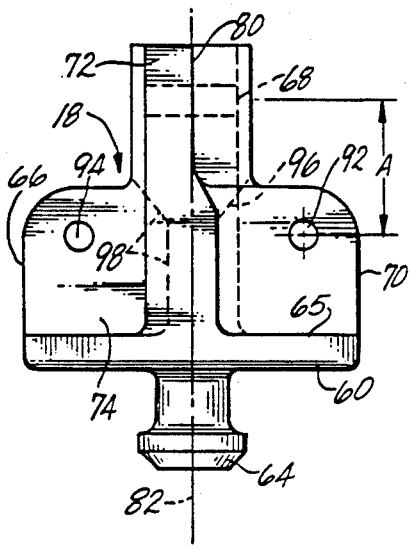
FIG. 3 is a top view of a frame hub.
Figure 4:
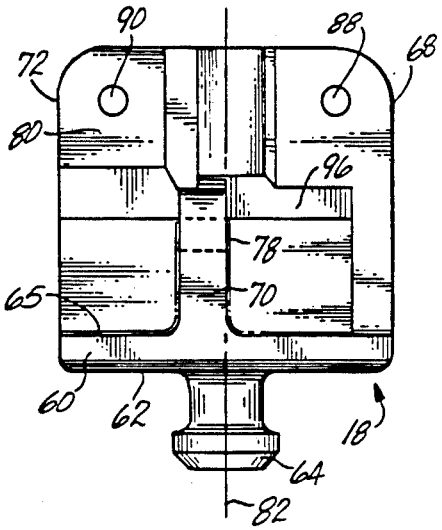
FIG. 4 is a side view of a frame hub.

In order to achieve nesting in the minimum space and make the folded framework as compact as possible, a unique hub is provided which allows the hub to be substantially reduced in size without sacrificing rigidity and strength of the framework. At the same time, the hub design of the present invention provides for ease of assembly in pivotally attaching the rods to the hubs. Details of the hub design are shown more clearly in FIGS. 3 through 5.

Figure 5:
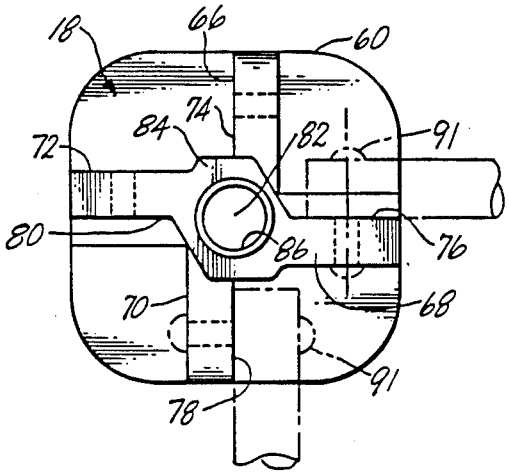
FIG. 5 is a front view of a frame hub.

Referring to these figures, the hub 18 is preferably molded of a suitable plastic material, but can be die-cast or otherwise formed of lightweight metal. The hub is formed with a base plate 60 which is generally square in outline with the corners rounded as shown in FIG. 5, and has a flat outer surface 62 from which projects a knob or flanged pin 64. the knob 64 is used to mount various auxiliary devices to the framework.

The top surface 65 of the hub base plate 60 has four flanges or hinge plates 66, 68, 70 and 72 projecting perpendicularly therefrom. These flanges are offset from each other, as viewed in FIG. 5, so that each flange provides a flat surface, indicated respectively at 74, 76, 78 and 80. These surfaces 74 and 78 lie in a second common plane, also passing through the central axis 82 of the hub. The flanges 68 and 72 project away from the base plate 60 a distance substantially twice that of the flanges 66 and 70. the other projecting ends of the flanges 68 and 72, which are hereinafter referred to as "high" flanges, intersect in an enlarged central portion 84 having an opening or hole 86 into which the latch rod 40 or latch receptacle 42 may be press-fitted or otherwise secured. High flanges 68 and 72 are provided with holes 88 and 90 adapted to receive a pivot pin or rivet 91 which pivotally secures the end of a tubular rod to the hub flange. The axes of the holes 88 and 90 are parallel to each other and lie in a common plane.

Similarly, the flanges 66 and 70, referred to as the "low" flanges of the hub, are provided with holes 92 and 94 that are adapted to receive the hinge pins or rivets 91 associated with additional tubular rods. The axes of the holes 92 and 94 are parallel to each other and lie in a common plane. The plane of the holes 92 and 94 is offset from the plane of the holes 88 and 90 by a distance "A". The backside of the high flanges 68 and 72 are undercut, as indicated at 96 and 98, respectively, to provide clearance for the ends of the rods pivotally attached to the low flanges as the rods are rotated about the axes of the holes 92 and 94.

As best seen in FIG. 6, the high and low flange arrangement of each hub, as described above, allows for the ends of four relatively large tubular rods to be pivotally attached to each hub by rivets 91. The offset "A" allows ready access to all the rivets 91 of each hub by suitable riveting equipment. Also, the flange configuration allows the outer perimeter of the base plate 60 to be made approximately equal to twice the diameter of the tubular rods, thus permitting the hubs to be made extremely compact and to nest against each other in two groups in the folded condition of the framework, as illustrated in FIG. 14.

Figure 12:
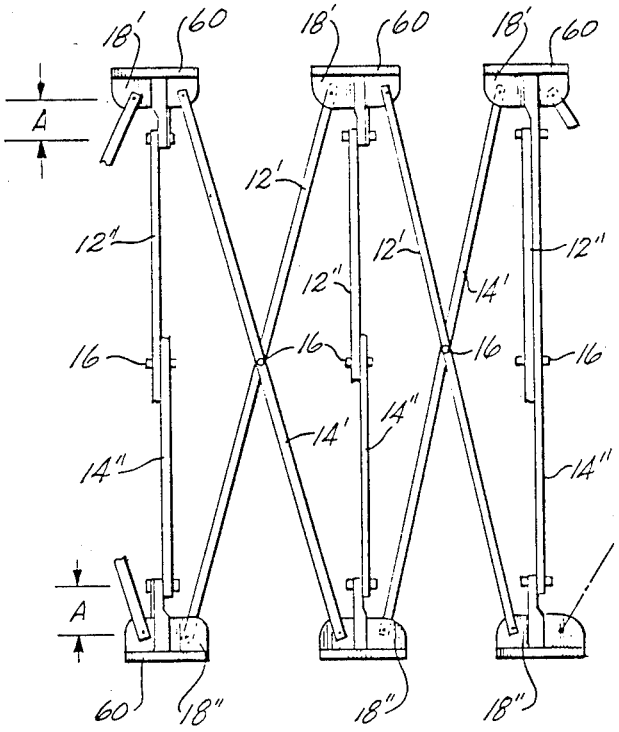
FIG. 12 is a detailed partial view of the frame in a nearly collapsed position.
Figure 13:
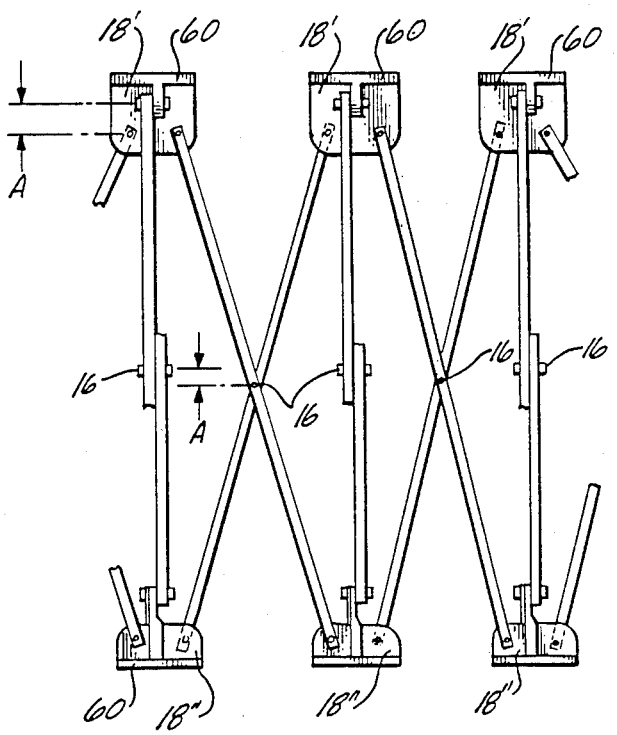
FIG. 13 is similar to FIG. 12 but showing an alternate construction.

Another advantage of the high, low flange arrangement of the hubs is that the rods in the horizontal rows can be of a different length than the rods in the vertical columns while still permitting the hubs to nest in two coplanar groups when the framework is in its folded position. This feature can be best understood by reference to FIG. 12, which shows a portion of the framework in a substantially folded position. As the framework is expanded into its open position by moving the hubs 18' toward the hubs 18'', the pair of rods 12' and 14' rotate into the horizontal rows, as shown in FIG. 1, while the rods 12'' and 14'' rotate into the vertical columns of the framework. Thus, the spacing between the hubs in the horizontal rows is determined by the length of the rods 12' and 14'' while the distance between the hubs in the vertical columns is determined by the length of the rods 12'' and 14''. If, as shown in FIG. 12, all of the horizontal rods 12' and 14' are pivotally joined to the low flanges of the hubs 18, and all the vertical rods 12'' and 14'' are pivotally connected to the high flanges of the hub 18, it becomes necessary for the vertical rods to be made shorter in length than the horizontal rods in order for the hubs in each of the two folded groups (see FIG. 14) to be coplanar. In fact, as seen in FIG. 12, the rods 12'' and 14'' are shorter, by an amount equal to 2A, than the horizontal rods 12' and 14'. As a result, when the framework is expanded to the open position, the openings or cubicles are not square but are rectangular, with the vertical dimension of each cubicle being smaller than the horizontal dimension by an amount substantially equal to 2A. Thus, the high, low flange arrangement of the hubs allows the designer to modify the width-to-height ratio of the erected or expanded framework. It should be noted that if it is desired to construct the framework with all of the rods being of identical length, this can be accomplished merely by rotating the hubs 18' 90 degrees relative to the hubs 18''. This causes the high flange of the hubs 8' to be aligned with a low flange of the hubs 18'' so that every rod is pivotally joined at one end to a low flange and at the other end is pivotally joined to a high flange. This alternative arrangement is shown in FIG. 13.

FIGS. 7 through 13 illustrate a system of diagonal stabilizing braces incorporated into the display frame to stabilize the display frame once it has been opened up and assembled into its expanded configuration. Because of the arcuate shape of the expanded frame and because weight hung from the frame is always on the front side of the frame, the forces resisting forward tipping of the frame are concentrated on the front extreme left and right bottom hubs. These loads cause a distortion of the outer cubicles into parallelograms, with the outermost frame array or cubicle on either the left or right side moving upward with respect to the next inward vertical array or cubicle. This invention provides a system of diagonal braces which prevents the lower cubicles from being distorted when weight is hung from the front of the display frame.

FIG. 1 illustrates a system of diagonal stabilizing braces mounted in the bottom cubicles of the expanded display frame. This system of diagonal stabilizing braces includes a lower left diagonal brace 100 mounted in the cubicle at the lower left corner of the expanded frame, a left inner diagonal brace 102 mounted in the next inward cubicle on the lower left side of the frame, a lower right diagonal brace 104 mounted in the cubicle at the lower right corner of the expanded frame, and a right inner diagonal frame 106 mounted in the next inward cubicle on the lower right side of the frame.

Figure 7:
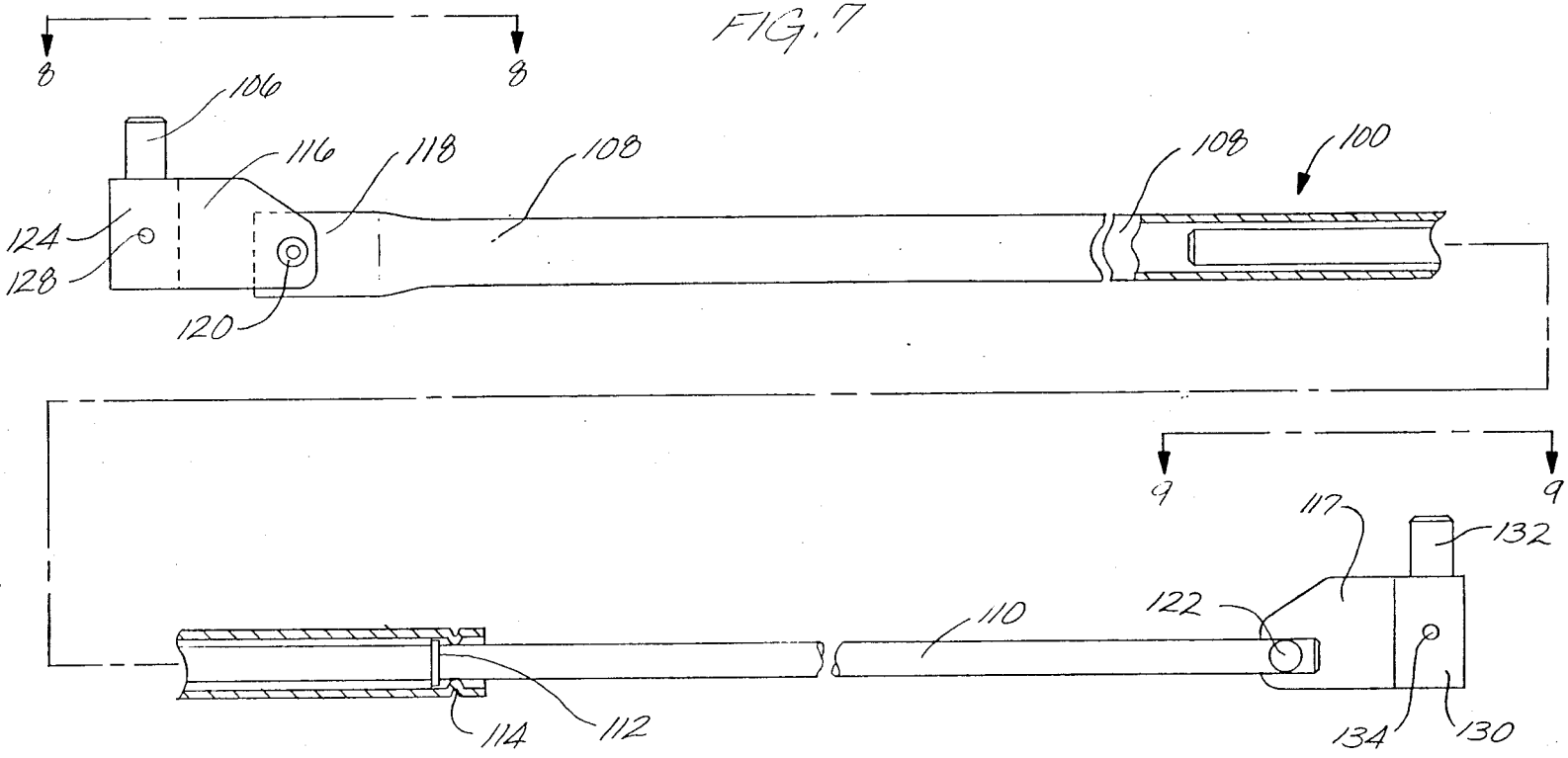
FIG. 7 is a fragmentary elevation view, partly broken away to reveal its cross-sectional configuration.
Figure 8:
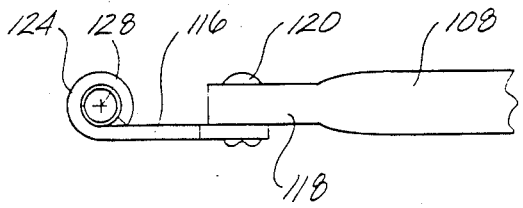
FIG. 8 is a fragmentary top view taken on line 8—8 of FIG. 7.
Figure 9:
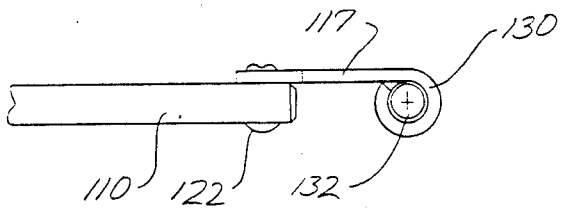
FIG. 9 is a fragmentary top view taken on line 9—9 of FIG. 7.

FIG. 7 illustrates the detailed construction of each diagonal stabilizing brace which, for the purposes of illustration, will be the lower left diagonal brace 100. The brace comprises a pair of telescoping rod members which include an elongated outer tube 108 of uniform diameter and circular cross section, and an elongated inner rod 110 which slides freely in the hollow interior within the outer tube. An annular stop 112 is affixed to the outer circumference of the inner rod at about the midpoint of the inner rod to project outwardly into sliding contact with the inside wall of the outer tube. Thus, as the inner rod slides back and forth inside the outer tube, the annular stop stabilizes the travel of the inner rod so that the inner rod travels reasonably coaxially with the axis of the outer tube and prevents binding. An annular shoulder 114 projects into the interior of the outer tube, near the end of the tube, to engage the stop on the inner rod and thereby restrict further travel of the inner rod out of the tube. The stop thereby restricts the maximum overall longitudinal dimension of the telescoping brace.

Separate mounting brackets 116 and 117 are affixed to opposite ends of the diagonal brace. An end portion 118 of each outer tube is flattened, and one bracket 116 is fastened to the flattened end portion by a rivet 120. The other bracket 117 is fastened to the end of the rod 110 by a rivet 122. The outer ends of the brackets 116 on the diagonal braces are bent into a rounded configuration to form a cylindrical sleeve 124 at the end of each bracket 116. Each sleeve 124 carries an outwardly projecting shaft 106 having a cylindrically curved outer surface. The shaft is held in the sleeve by a spring pin 128. At the opposite end of each diagonal brace, the outer end of the bracket 117 is bent into a rounded configuration to form a cylindrical sleeve 130 at the end of the bracket. Each sleeve 130 carries an outwardly projecting shaft 132 having a cylindrically curved outer surface, and the shaft is held in the sleeve by a spring pin 134.

The brackets at the ends of the diagonal stabilizing braces are secured to hubs at the corners of the bottom cubicles of the frame. As described previously, the inside face of each hub has a bore to receive cross braces extending between front and back planes of the expanded framework for holding the front and rear faces of the framework in a fixed position relative to each other. The shafts 128 and 132 at the ends of each diagonal brace are adapted to engage the bores on the inside faces of the hubs at the corners of the bottom cubicles for mounting the brace in a diagonal position in the cubicles at the bottom of the frame.

Figure 10:
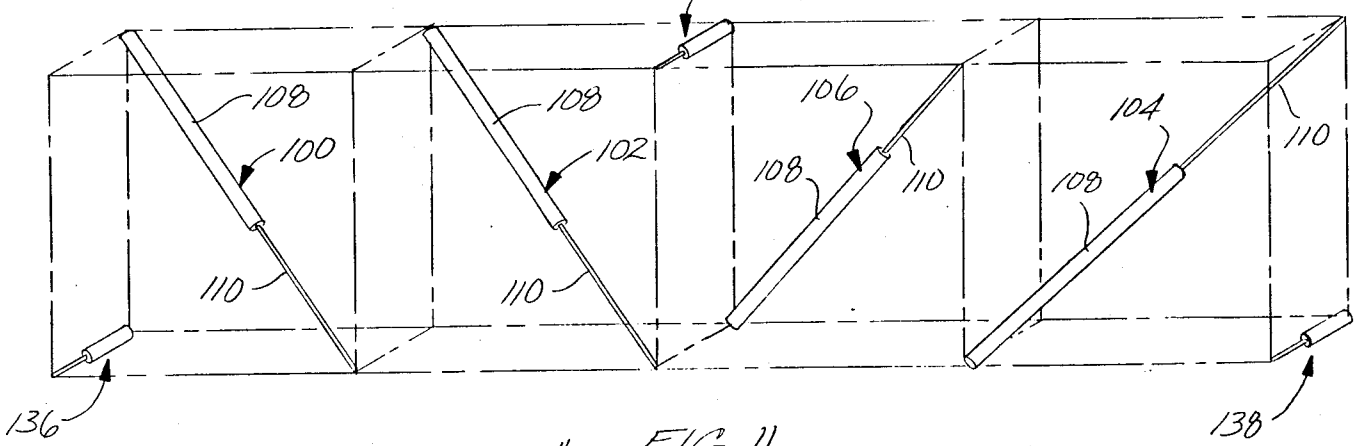
FIG. 10 is a semi-schematic view in perspective showing assembly of stabilizing diagonals in symbolic lower quadrants of the unfolded display frame.

FIG. 10 illustrates a preferred arrangement of diagonal braces in a display frame having four side-by-side cubicles at the bottom on the frame. This arrangement schematically represents the four diagonal braces 100, 102, 104 and 106 illustrated in FIG. 1. As shown best in FIG. 10, only a single telescoping diagonal brace is mounted within each cubicle. On one side of the frame the braces slant in one direction, and on the other side of the frame the braces slant in the opposite direction. In the illustrated embodiment, each telescoping brace 100 and 102 on the left side of the frame slants from an upper left corner to a lower right corner of its corresponding cubicle. Each of the telescoping braces 104 and 106 on the right side of the frame slant from an upper right corner to a lower left corner of its corresponding cubicle. Each diagonal brace also is mounted at one end to a front corner of the cubicle and mounted at its opposite end to a rear corner of the cubicle. The sliding inner rods 110 of the braces also are secured to lower corners of the cubicles on one side of the frame and to upper corners of the cubicles on the opposite side of the frame. Thus, in the illustrated embodiment of FIG. 10, the ends of the rods 110 of the braces 100 and 102 on the left side of the frame are secured to the lower front right corner hubs of the frame. The ends of the outer tubes 108 of the same diagonal braces on the left side of the frame are secured to the hubs at the upper left rear corners of the respective cubicles. On the right side of the frame, each of the diagonal braces 104 and 106 extends from a corner at a front side of the cubicle to an opposite corner at the rear side of the cubicle. However, the diagonal braces 104 and 106 are not mounted in an identical configuration as are the braces 100 and 102 on the left side of the frame. As to the right-side braces, the end of the sliding rod 110 of the brace 104 is mounted to the hub at the upper rear corner of its cubicle and the end of the outer tube 108 is mounted on the hub at the lower front corner of the cubicle. The end of the sliding rod 110 of the diagonal brace 106 is mounted to the hub at the front upper right corner of the cubicle and the end of the outer tube 108 is mounted to the hub at the rear left corner of the cubicle.

Further stabilization is provided by telescoping braces or stab connectors extending between the front and rear faces of the frame. These connections include a brace 136 at the lower left corner of the frame, a brace 138 at the lower right corner of the frame, and a brace 140 at the top center of the bottom row of cubicles.

Figure 11:
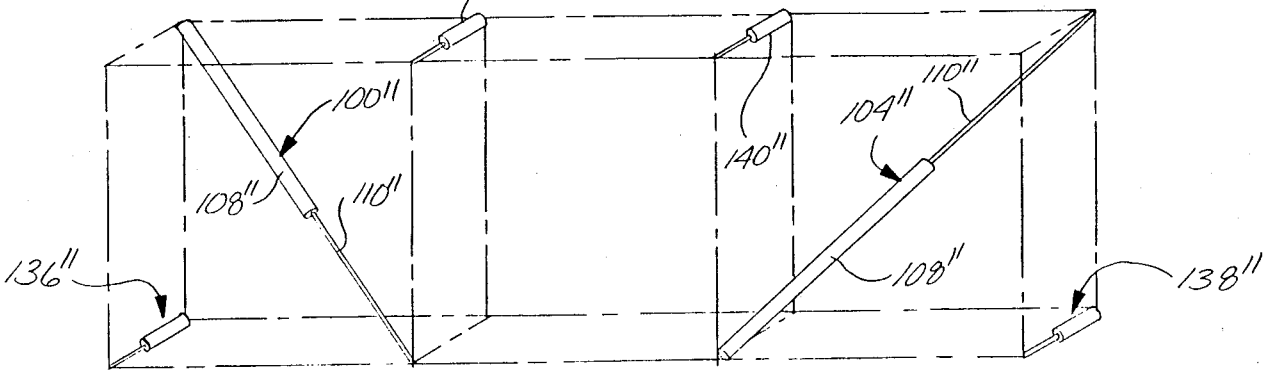
FIG. 11 is a semi-schematic view in perspective similar to FIG. 10 showing the assembly of diagonals for a smaller display frame.

FIG. 11 illustrates a preferred arrangement for mounting the diagonal stabilizing braces in a display frame having three side-by-side cubicles at the bottom of the frame.

In use, when the display frame is opened to its expanded configuration, the inner rods 110 slide out of the corresponding outer tubes 108. In their fully extended position, the stop in each telescoping diagonal brace engages the shoulder on the inside of the outer tube to restrict further relative sliding motion so that the maximum length of each diagonal is restricted to the diagonal distance between a lower corner at one side of the cubicle to an upper corner at the opposite side of the cubicle. During use of the frame when weight is hung from the front side of the frame, the forces acting on the frame which resist forward tipping of the frame are concentrated at the front extreme left and right bottom hubs. This would normally cause a distortion of the outer cubicles into parallelogram shapes as the outermost frame array on either side of the frame moves upward with respect to the next inward vertical cubicle. However, the diagonal braces prevent the lower cubicles from being distorted into a parallelogram shape. As a result, the frame is stabilized and prevented from tipping over.

What is claimed is:

1. A stabilized folding framework comprising a grid of horizontal and vertical rod members forming an array of three dimensional cubicles, each cubicle being defined by a top plane, a bottom plane, two side planes, a front plane, and a rear plane, these planes cooperating to define eight corners of each cubicle, the framework forming each cubicle having a top frame section, a bottom frame section, and two side frame sections, each frame section being formed by two rods intersecting and pivotally joined to each other midway between their ends, the ends of the rods of each cubicle being pivotally attached to corresponding hubs located at each of the corners of the cubicle, adjacent cubicles in the array sharing common rods and hubs, and separate diagonal stabilizing members located within predetermined bottom cubicles of the display frame to prevent such cubicles from being distorted when the display frame is erected into a fixed position, each diagonal stabilizing member comprising a telescoping brace comprised of inner and outer rod members, the rod members of each telescoping brace being slidable relative to each other to adjust the length of the brace, the rod members of each diagonal brace having means for restricting the maximum long dimension of the brace, the diagonal braces being mounted within predetermined bottom cubicles of the frame so that they operate as a restraint in the tension direction to restrict said bottom cubicles from distorting, the diagonal braces being arranged in said bottom cubicles to slant in one direction on one side of the frame and to slant in the opposite direction on the other side of the frame.

2. Apparatus according to claim 1 in which each diagonal extends from a hub at a front portion of the cubicle to a hub at the opposite diagonal corner at a rear portion of the cubicle.

3. Apparatus according to claim 1 in which the frame can be folded into a compact form or opened up into its expanded configuration without removing the diagonal braces from the bottom cubicles.

4. In a folding open framework comprising a plurality of pivotally joined pairs of rod members in which four of said pairs of rod members are pivotally joined at their ends by eight hub members to form four sides of a rectangular cubicle having a hub at each of the eight corners of the cubicle, a plurality of said cubicles forming an array with adjoining cubicles sharing a common pair of rod members and the associated four hub members at each of the ends of the pair of rod members, the improvement comprising:

each hub member having a base plate with flanges projecting therefrom for pivotally supporting a first pair of said rod members secured to a corresponding first pair of flanges on opposite sides of a central axis of a hub and a second pair of said rod members secured to a corresponding second pair of said flanges on opposite sides of the central axis of the hub, said second flanges extending substantially perpendicular to said first flanges;

the first pair of flanges having corresponding first bearing surfaces lying substantially on a first axis passing essentially through the central axis of the hub, the pair of second flanges having corresponding second bearing surfaces lying substantially on a second axis passing essentially through the central axis of the hub and extending substantially perpendicularly to the first axis;

the ends of the first rod members pivotally secured to the first bearing surfaces being rotatable thereon about spaced-apart axes of revolution extending substantially parallel to each other, and lying substantially in a first plane, the ends of the second rod members pivotally secured to said second bearing surfaces being rotatable thereon about spaced-apart axes of revolution extending substantially parallel to each other and lying substantially in a second plane which is spaced outwardly from the base plate by a greater distance than said first plane and which lies substantially parallel to said first plane;

separate diagonal stabilizing members located within predetermined bottom cubicles of the display frame to prevent such cubicles from being distorted when the frame is erected in its fixed position;

each diagonal stabilizing member comprising a telescoping brace comprised of inner and outer rod members, the rod members of each telescoping brace being slidable relative to each other to adjust the length of the brace, the rod members of each diagonal brace having means for restricting the maximum long dimension of the brace, the diagonal braces being mounted within said predetermined bottom cubicles of the frames so that they operate as a restraint in the tension direction to restrict said bottom cubicles from distorting in shape, the diagonal braces being arranged in said bottom cubicles of the frame to slant in one direction on one side of the frame and to slant in an opposite direction on the other side of the frame.

5. Apparatus according to claim 4 in which each diagonal brace extends from a hub at a front portion of a cubicle to a hub at an opposite diagonal corner at the rear portion of the cubicle.

* * * * *